US012631176B2

(12) United States Patent
Kwon et al.

(10) Patent No.: US 12,631,176 B2
(45) Date of Patent: May 19, 2026

(54) PISTON UNIT FOR COMPRESSOR

(71) Applicant: Standard Cooling System Inc., Asan-si (KR)

(72) Inventors: Mihye Kwon, Sejong-si (KR); Hyeong Kyu Jin, Sejong-si (KR)

(73) Assignee: Standard Cooling System Inc., Asan-si (KR)

( * ) Notice: Subject to any disclaimer, the term of this patent is extended or adjusted under 35 U.S.C. 154(b) by 29 days.

(21) Appl. No.: 18/380,208

(22) Filed: Oct. 16, 2023

(65) Prior Publication Data

US 2024/0125319 A1 Apr. 18, 2024

(30) Foreign Application Priority Data

Oct. 17, 2022 (KR) ..... 10-2022-0133277

(51) Int. Cl.

| | |
|---|---|
| ***F04B 35/04*** | (2006.01) |
| ***F04B 39/00*** | (2006.01) |
| ***F04B 53/14*** | (2006.01) |
| *F25B 31/02* | (2006.01) |

(52) U.S. Cl.

CPC ..... *F04B 53/14* (2013.01); *F04B 35/045* (2013.01); *F04B 39/0005* (2013.01); *F25B 31/023* (2013.01)

(58) Field of Classification Search

None

See application file for complete search history.

(56) References Cited

U.S. PATENT DOCUMENTS

| | | | | | |
|---|---|---|---|---|---|
| 2,988,264 | A * | 6/1961 | Reutter | F04B 35/045 | 417/418 |
| 3,791,770 | A * | 2/1974 | Farkos | F04B 5/02 | 417/418 |
| 4,965,864 | A * | 10/1990 | Roth | H02K 41/031 | 417/418 |
| 7,665,510 | B2 * | 2/2010 | Nara | F28F 13/10 | 417/417 |

FOREIGN PATENT DOCUMENTS

| | | | | |
|---|---|---|---|---|
| CN | 108412733 | A | 8/2018 | |
| DE | 3126467 | A1 * | 1/1983 | |
| DE | 19943993 | A1 * | 3/2001 | F02B 75/28 |
| JP | 2011-111978 | A | 6/2011 | |
| KR | 10-0603943 | B1 | 7/2006 | |
| KR | 10-2023-0077856 | A | 6/2023 | |
| KR | 10-2023-0111728 | A | 7/2023 | |

OTHER PUBLICATIONS

DE 19943993 A1 machine translation from PE2Esearch (Year: 2025).*

DE 3126467 A1 machine translation from espacenet (Year: 2025).*

* cited by examiner

*Primary Examiner* — Michael Quandt

(74) *Attorney, Agent, or Firm* — Park, Kim & Suh, LLC

(57) ABSTRACT

Disclosed is a piston unit for a compressor including a first head provided in an area for linear reciprocal movement in the compressor, a second head disposed to be spaced apart from the first head along a movement direction of the linear reciprocal movement, and a bridge connecting the first head and the second head, and including a first magnetic member and a second magnetic member having a polarity that is different from that of the first magnetic member, in an area between the first head and the second head.

7 Claims, 3 Drawing Sheets

PISTON UNIT FOR COMPRESSOR

CROSS-REFERENCE TO RELATED APPLICATIONS

This application claims priority to and the benefit of Korean Patent Application No. 10-2022-0133277 filed in the Korean Intellectual Property Office on Oct. 17, 2022, the entire contents of which are incorporated herein by reference. of the present disclosure described herein relate to a piston unit provided in a compressor.

BACKGROUND

Embodiments of the present disclosure described herein relate to a piston unit provided in a compressor.

As an issue receiving the most attention in the automobile industry in recent years is an improved fuel efficiency, researches by automakers are focused on reducing weights of vehicles and improving performances of compressors. However, in the case of devices requiring a high cooling capacity, the compressor package becomes larger in proportion to a size of a motor, which is a power device to improve performance. In addition, as the automobile industry has recently moved from existing internal combustion engine vehicles to eco-friendly electric vehicles, there is a need for a change from a belt drive method that uses a rotational force of the engine to an electric drive method that has its own power source whereby it is natural to require improvement of performance through a change of a design of the entire compressor.

SUMMARY

Embodiments of the present disclosure provide a piston unit for a compressor, which is designed to improve performance.

According to an aspect of the present disclosure, a piston unit for a compressor includes a first head provided in an area for linear reciprocal movement in the compressor, a second head disposed to be spaced apart from the first head along a movement direction of the linear reciprocal movement, and a bridge connecting the first head and the second head, and including a first magnetic member and a second magnetic member having a polarity that is different from that of the first magnetic member, in an area between the first head and the second head.

According to an embodiment, an area of a cross-section of the first head, which is perpendicular to the movement direction, and an area of a cross-section of the second head, which is perpendicular to the movement direction, may be larger than an area of a cross-section of the bridge, which is perpendicular to the movement direction.

According to an embodiment, the bridge may further include a third magnetic member having the same polarity as that of the first magnetic member and a fourth magnetic member having the same polarity as that of the second magnetic member, and the first magnetic member, the second magnetic member, the third magnetic member, and the fourth magnetic member may be disposed in a sequence of the first magnetic member, the second magnetic member, the third magnetic member, and the fourth magnetic member along the movement direction.

According to an embodiment, the linear reciprocal movement may be related to a magnetic force formed based on at least one of the first magnetic member and the second magnetic member.

According to an embodiment, the piston unit may further include a coil that forms the magnetic force, and a diameter of a cross-section of the coil, which is perpendicular to the movement direction, may be larger than a diameter of a cross-section of the first head, which is perpendicular to the movement direction.

According to an embodiment, at least one of the first head, the second head, and the bridge includes in a form of a cylinder.

According to an embodiment, at least one of the first head or the second head may include a layer member including a polymeric material on a side thereof.

According to an embodiment, the polymeric material may include Teflon™.

According to an embodiment, the first magnetic member and the second magnetic member may include a form of at least one of a band or a ring.

According to an embodiment, a path of the linear reciprocal movement may be determined based on a lower surface of the first head and an upper surface of the second head.

BRIEF DESCRIPTION OF THE FIGURES

The above and other objects and features of the present disclosure will become apparent by describing in detail embodiments thereof with reference to the accompanying drawings.

DETAILED DESCRIPTION

Figure 1:
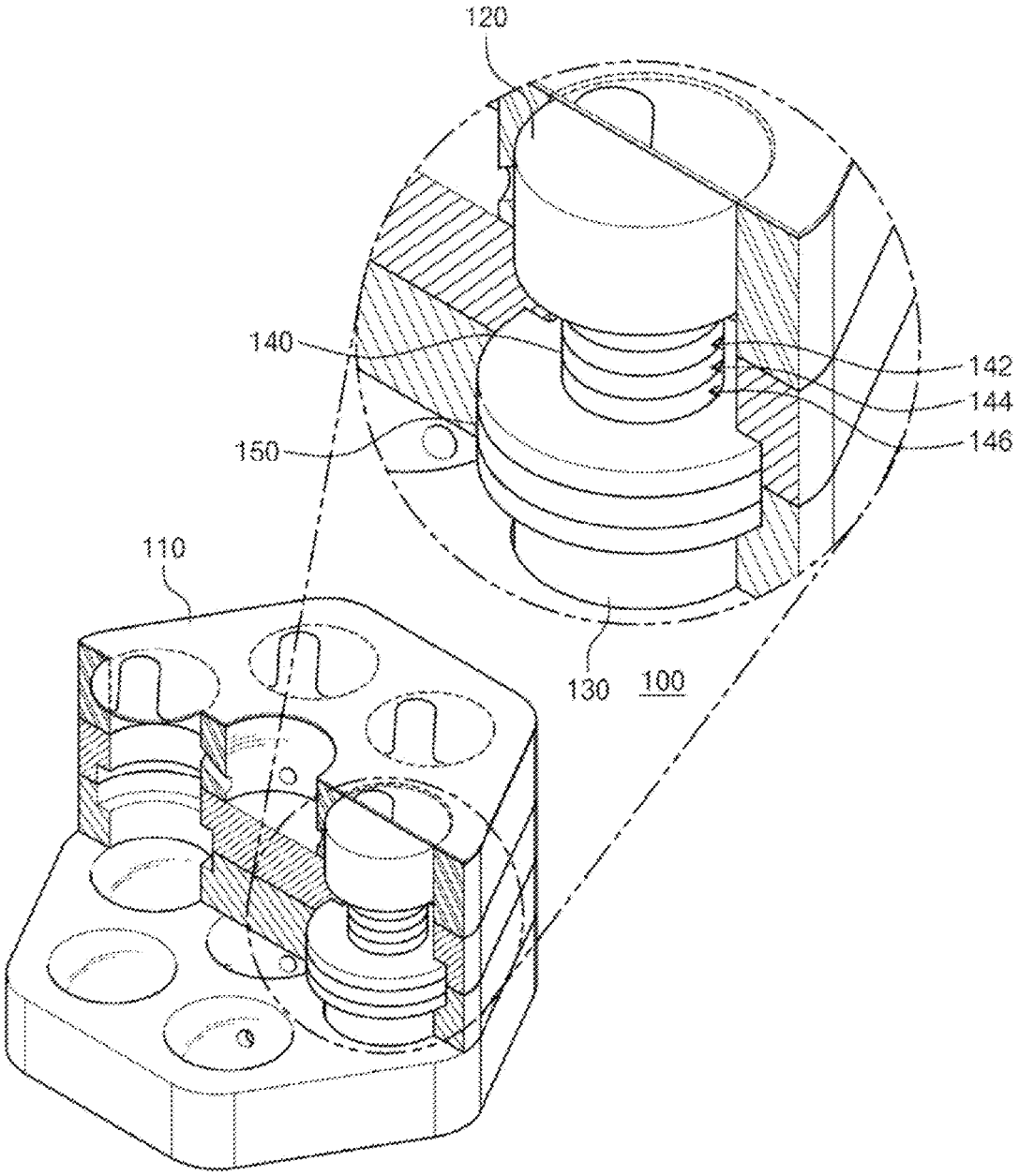
FIG. 1 is an example of a piston unit for a compressor according to an embodiment of the present disclosure.

Hereinafter, detailed embodiments for carrying out the present disclosure will be described in detail with reference to the drawings. In the following description, when a detailed description of widely known functions or configurations may make the essence of the present disclosure unclear, a detailed description thereof will be omitted.

In the accompanying drawings, the same or corresponding components are denoted by the same reference numerals. Furthermore, in the description of the following embodiments, a repeated description of the same or corresponding components may be omitted. However, even when the description of the components is omitted, it is not intended that the components are not included in some embodiments.

The advantages and the features of the present disclosure, and the method for achieving them will become apparent with reference to the embodiments described below together with the accompanying drawings. However, the present disclosure is not limited by the embodiments disclosed below and may be implemented in various different forms, and the embodiments are simply provided to make the disclosure of the present disclosure complete and to fully inform an ordinary person in the art, to which the inventive concept pertains, of the scope of the present disclosure.

The terms used in the specification will be briefly described, and the disclosed embodiments will be described in detail. General terms used as currently widely as possible are selected as the terms used in the specification in consideration of the functions in the present disclosure, but the terms used in the specification may be changed according to an intention of an ordinary person in the art, to which the present disclosure pertains, a precedent, or advent of a new technology. Furthermore, in a specific case, terms may be arbitrarily selected by the applicant(s), and in this case, the meanings thereof will be described in detail in the detailed description of the invention. Accordingly, the terms used in the specification should be construed based on not the simple names of the terms or substantial meanings of the terms, and the contents over the specification.

In the specification, a singular expression includes a plural expression unless the singular expression is explicitly described in the context. Furthermore, a plural expression includes a singular expression unless the plural expression is explicitly described in the context. Furthermore, when it is described that a central part includes a certain component, this means that another component may be further included while other components are not excluded unless described particularly in an opposite way.

Furthermore, the terms of 'module or part' used in the specification means a software or hardware component, and the 'module or part' performs some functions. However, the 'module or part' is not limited to a meaning that is restricted to software or hardware. The 'module or part' may be configured to be in a storage medium that may be addressed, and may be configured to reproduce one or more processors. Accordingly, in an example, the 'module or part' may include at least one of components, such as software components, object-oriented software components, class components, and task components, processes, functions, attributes, procedures, subroutines, segments of a program code, drivers, firmware, micro codes, circuits, data, databases, data structures, tables, arrays, or parameters. The functions provided in the components, and the 'modules or parts' may be coupled to a smaller number of components, or 'modules or parts' or may be further separated to additional components, or 'modules or parts'.

FIG. 1 illustrates an example of a piston unit 100 for a compressor according to an embodiment of the present disclosure. Here, a compressor means a mechanical device that is provided in a vehicle, a ship, or a home appliance to perform an operation of compressing a refrigerant of a low temperature and a low pressure to a high temperature and a high pressure due to movement of the piston unit 100. As illustrated, the piston unit 100 of the present disclosure may be provided in a cylinder 110 to perform linear movement. Here, the cylinder 110 may refer to a member that is configured to provide an area (that is, an area for linear reciprocal movement of the piston unit 100) for compressing the refrigerant of the piston unit 100 in the compressor. Here, a movement direction of the linear reciprocal movement may include an upward linear and/or downward linear direction with reference to FIG. 1.

The piston unit 100 may include two heads 120 and 130, and a bridge 140 including magnetic members. The two heads 120 and 130 may have shapes corresponding to shapes of areas (or spaces) provided in the cylinder 110 for the linear reciprocal movement. For example, the two heads 120 and 130 may have cylindrical members to correspond to the cylindrical spaces of the heads 120 and 130. Then, diameters of the two heads 120 and 130 may be sizes corresponding to the cylindrical spaces of the cylinder 110 such that the introduced refrigerant is not leaked.

The two heads 120 and 130 may be disposed on an upper side and a lower side of the piston unit 100 to be spaced apart from each other. Then, the bridge 140 may be connected to the first head 120 and the second head 130. In detail, the first head 120 may be connected to an upper end of the bridge 140 and the second head 130 may be connected to a lower end of the bridge 140 and thus, the bridge 140 may connect the first head 120 and the second head 130.

The bridge 140 may include a first magnetic member 142 and a second magnetic member 144 in an area between the first head 120 and the second head 130. Here, the second magnetic member 144 may refer to a magnetic member having a polarity that is different from that of the first magnetic member 142. For example, the first magnetic member 142 may include an S pole magnetic member, and the second magnetic member 144 may include an N pole magnetic member, and vice versa.

The bridge 140 may have a column shape. For example, a cross-section of the bridge 140, which is perpendicular to the movement direction of the linear movement may have a cylindrical shape. As another example, the bridge 140 may have a polygonal column shape, a horizontal cross-section of which is polygonal. In this case, a diameter of the horizontal cross-section of the bridge 140 may be smaller than a horizontal cross-section of the first head 120 and/or the second head 130. That is, an area of a cross-section of the second head 130, which is perpendicular to an area of a cross-section of the first head 120, which is perpendicular to the movement direction, and the movement direction may be larger than an area of the bridge 140, which is perpendicular to the movement direction. The configuration is provided to ensure a space of a coil 150 provided in the compressor (or the cylinder 110) to induce the linear reciprocal movement by a permanent magnet (here, the first magnetic member 142 and the second magnetic member 144) of the piston unit 100. The description thereof will be described below in FIG. 3.

Figure 2:
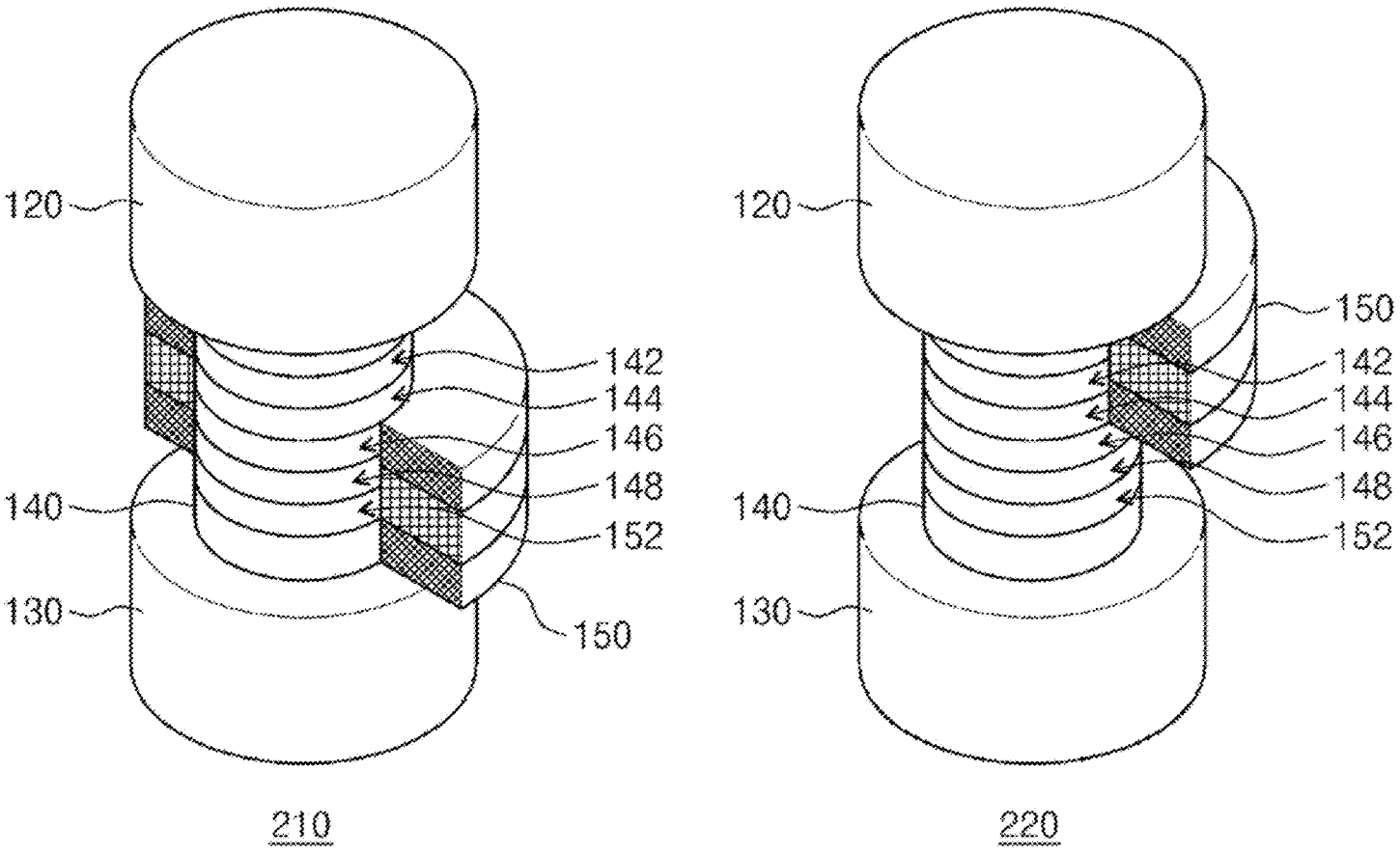
FIG. 2 is a perspective view of a piston unit coupled to a coil.

FIG. 2 is a perspective view of the piston unit 100 coupled to the coil 150. As illustrated, the bridge 140 of the piston unit 100 may include a plurality of magnetic members 142 to 152. In this case, the first magnetic member 142, the third magnetic member 146, and the fifth magnetic member 152 may include N pole magnetic members. Furthermore, the second magnetic member 144 and the fourth magnetic member 148 may include S pole magnetic members. Here, it may be construed that the N pole and the S pole may be replaced by each other.

The plurality of magnetic members 142 to 152 may be provided in the bridge 140 in a form, in which the magnetic members having opposite polarities are alternately disposed along the linear movement direction. For example, the first magnetic member 142, the second magnetic member 144, the third magnetic member 146, the fourth magnetic member 148, and the fifth magnetic member 152 may be disposed in a sequence of the first magnetic member 142, the second magnetic member 144, the third magnetic member 146, the fourth magnetic member 148, and the fifth magnetic member 152 along the linear movement direction (here, a vertically downward direction) of the piston unit 100. In this case, when a current is applied to a coil 150, a magnetic force (that is, a repulsive force) between at least one of the first magnetic member 142, the second magnetic member 144, the third magnetic member 146, the fourth magnetic member 148, and the fifth magnetic member 152, and the coil 150 may be formed. That is, the linear reciprocal movement of the piston unit 100 may be related to a magnetic force formed based on at least one of the first magnetic member 142, the second magnetic member 144, the third magnetic member 146, the fourth magnetic member 148, and the fifth magnetic member 152. Furthermore, in a specific case, the linear reciprocal movement of the piston unit 100 may be performed by a magnetic force formed based on at least one of the first magnetic member 142, the second magnetic member 144, the third magnetic member 146, the fourth magnetic member 148, and the fifth magnetic member 152. Meanwhile, as illustrated in FIG. 1, areas having no magnetic member may be present at opposite ends of the bridge 140.

Meanwhile, the plurality of magnetic members 142 to 152 may be provided in the bridge 140 in a form of a band and/or a ring. In detail, the bridge 140 may be provided in a form, in which a cylindrical member. is surrounded by the plurality of magnetic members 142 to 152 in a form of a band and/or a ring. Additionally or alternatively, the bridge 140 may be provided in a form, in which the plurality of magnetic members 142 to 152 that are cylindrical are stacked.

Additionally, the first head 120 and/or the second head 130 may include layer members 212 and 214 including a polymeric material on side surfaces thereof. For example, the layer members 212 and 214 may be members in a form of a thin film that surrounds side surfaces of the first head 120 and/or the second head 130. Here, the layer members 212 and 214 may refer to members that are provided to enhance a coefficient of performance (COP) by decreasing a frictional coefficient between a side wall of the space for the linear movement in the compressor and the piston unit 100. For example, the layer members 212 and 214 may include Teflon™.

Figure 3:
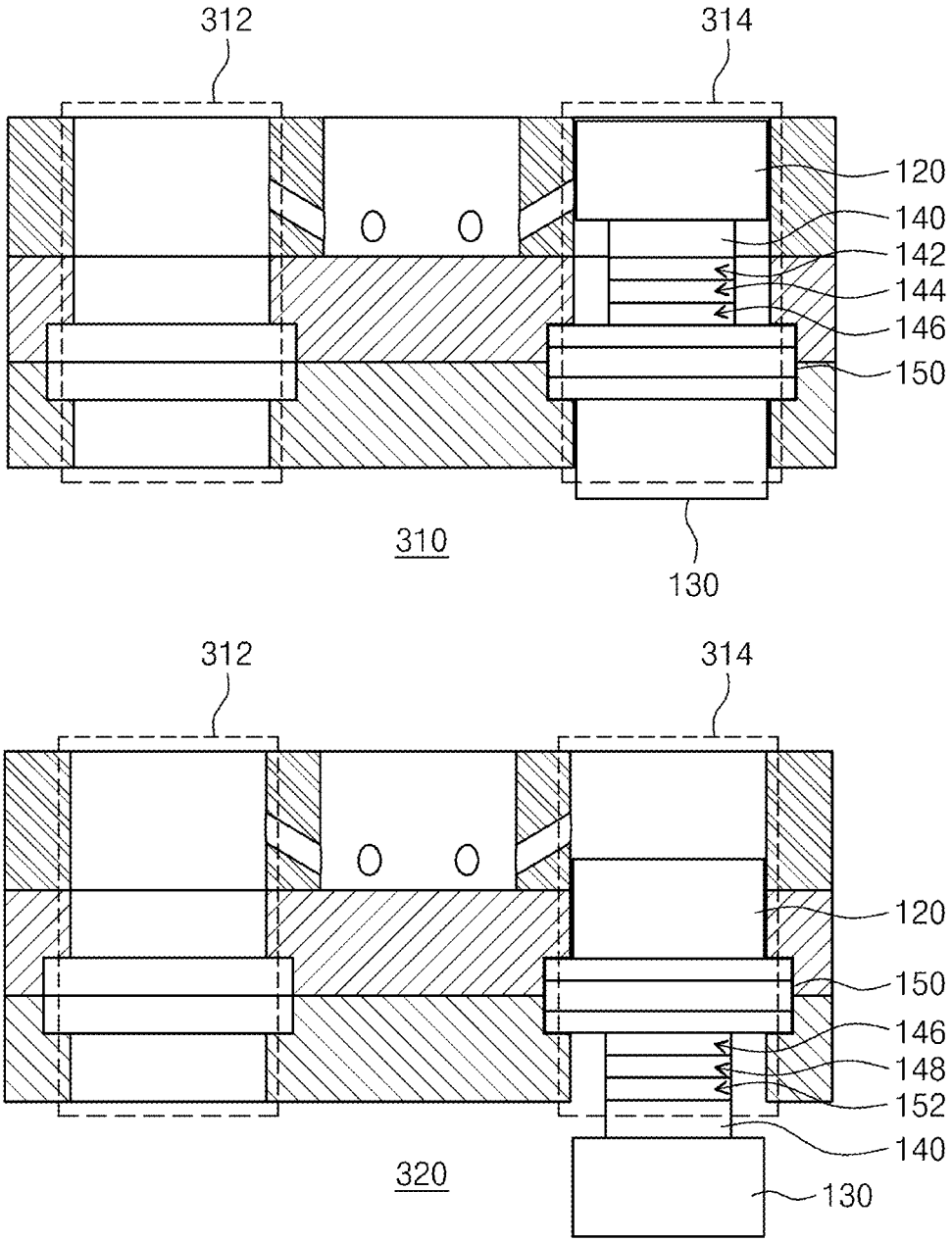
FIG. 3 is a view illustrating linear movement of a piston unit.

FIG. 3 is a view illustrating linear movement of the piston unit 100. A first operation 410 is an operation of introducing a refrigerant of a low temperature and a low pressure, and a second operation 420 is an operation of compressing the introduced refrigerant of the low temperature and the low pressure to a high temperature and a high pressure by linearly moving the piston unit 100 in a vertically downward direction. As illustrated, the coil 150 may be fixedly disposed in a first area 312 that is provided for the linear reciprocal movement of the piston unit 100 in the cylinder 110. In detail, the coil 150 may be a doughnut-shaped member that is configured such that a diameter thereof is larger than that of a horizontal cross-section of the first head 120 and/or the second head 130, and may be provided to be fixed to a side groove of the first area 312. Accordingly, the piston unit 100 may perform the linear reciprocal movement with respect to the coil 150 due to a repulsive force formed between the coil 150 and the plurality of magnetic members.

In detail, an upper surface of the second head 130 contacts a lower surface of the coil 150 in a first operation 310, and then, when a vertically downward movement is performed, a lower surface of the first head 120 contacts an upper surface of the coil 150 in a second operation 320. That is, a path of the linear reciprocal movement of the piston unit 100 is determined by the lower surface of the first head 120 connected to the bridge 140 and the upper surface of the second head 130 connected to the bridge 140.

Meanwhile, as described above in FIG. 1, an area of a cross-section of the first head 120, which is perpendicular to the movement direction of the piston unit 100 and an area of a cross-section of the second head 130, which is perpendicular to the movement direction may be larger than an area of the bridge 140, which is perpendicular to the movement direction. Accordingly, the space of the coil 150 that is a member for inducing a magnetic force in the cylinder 110 may be secured, and a specific interval between a second area 314 and the first area 312 for another piston unit (not illustrated) that performs the linear reciprocal movement as in the piston unit 100 in the cylinder 100 may be ensured as well. When an area (or a diameter) of the bridge 140 is the same as or wider (larger) than that of the first head 120 and/or the second head 130, a horizontal length "L" of the side groove that has to be provided for the coil 150 in the cylinder 110 increases. However, when the area (or the diameter) of the bridge 140 is smaller than the area of the first head 120 and/or the second head 130 as in the piston unit 100 of the present disclosure, it is advantageous to design a compressor, in which a plurality of piston units including the piston unit 100 in one cylinder 110, in an aspect of spatial efficiency. Furthermore, because the area (or the diameter) of the bridge 140 is smaller than the area of the first head 120 and/or the second head 130 as in the piston unit 100 of the present disclosure, an area, in which the piston unit 100 contacts a side surface of the bridge 140 while generating frictions when the piston unit 100 performs the linear reciprocal movement, is only an inner side surface of the doughnut-shaped coil 150 and no contact is made on a side surface of the first area 312 whereby the entire COP of the compressor may be maximized.

According to some embodiments of the present disclosure, a coefficient of performance (COP) of the compressor may be maximized by providing the piston unit in a form, in which a plurality of linear movement space may be provided in the compressor.

According to some embodiments, a coefficient of performance (COP) of the compressor may be maximized by providing the piston unit in a form, in which an energy loss rate due to frictions may be reduced.

The above description of the present disclosure is provided to allow an ordinary person in the art to perform or use the present disclosure. Various modifications of the present disclosure will be apparent to an ordinary person in the art, and the general principles defined herein may be applied to various modifications without deviating from the purpose or range of the present disclosure. Accordingly, the present disclosure is not intended to be limited to the examples described herein, and is intended to give a widest range that agrees with the principles and new features disclosed herein.

Although the present disclosure has been described in relation to some embodiments, it is noted that an ordinary person in the art, to which the present disclosure pertains, may make various modifications and changes without departing from the scope of the present disclosure. In addition, the modifications and changes should be considered to fall within the scope of the claims attached to the specification.

What is claimed is:

1. A piston unit for a compressor, comprising:

a first head provided in a first chamber of a cylinder for a first linear reciprocal movement in the first chamber;

a second head provided in a second chamber of the cylinder for a second linear reciprocal movement in the second chamber, wherein the second head is vertically spaced apart from the first head;

a bridge connecting the first head and the second head; and a coil member provided around the bridge and fixed to the cylinder, wherein an outer diameter of the coil member is greater than a diameter of the first and second chambers, wherein the bridge comprises:

a first non-magnetic portion coupled to the first head;

a second non-magnetic portion coupled to the second head; and a magnetic portion provided between the first and second non-magnetic portions, wherein a diameter of the first and second non-magnetic portions is equal to a diameter of the magnetic portion, wherein an inner diameter of the coil member is less than a diameter of the first and second heads, wherein the magnetic portion of the bridge includes first, second, third, fourth, and fifth magnetic members, wherein the diameter of the first and second heads is greater than a diameter of the first, second, third, fourth, and fifth magnetic members, wherein all of the first, second, third, fourth, and fifth magnetic members are adjacent to each other.

2. The piston unit of claim 1, wherein an area of a cross-section of the first head and an area of a cross-section of the second head are larger than an area of a cross-section of the bridge.

3. The piston unit of claim 1, wherein the first and second linear reciprocal movements are related to a magnetic force generated by at least one of the first, second, third, fourth, and fifth magnetic members.

4. The piston unit of claim 3, wherein the outer diameter of the coil member is greater than the diameter of the first and second heads.

5. The piston unit of claim 1, wherein at least one of the first head, the second head, and the bridge is cylindrical.

6. The piston unit of claim 1, wherein at least one of the first, second, third, fourth, and fifth magnetic members has a band or ring shape.

7. The piston unit of claim 1, wherein a path of the first and second linear reciprocal movements is determined based on a lower surface of the first head and an upper surface of the second head.

* * * * *